United States Patent [19]

Kepler

[11] 4,248,430

[45] Feb. 3, 1981

[54] GOLF PUTTER

[76] Inventor: Don L. Kepler, 1050 Old Dixie Hwy., Lake Park, Fla. 33403

[21] Appl. No.: 966,874

[22] Filed: Dec. 6, 1978

[51] Int. Cl.[3] ..... A63B 53/00

[52] U.S. Cl. ..... 273/162 D; 273/162 E; 273/169; 294/19 A

[58] Field of Search ..... 273/162 E, 32 F, 162 R, 273/162 D, 162 F; 294/19 A

[56] References Cited

U.S. PATENT DOCUMENTS

| | | | |
|---|---|---|---|
| 2,561,815 | 7/1951 | Oberg | 294/19 A |
| 3,064,975 | 11/1962 | Smith | 273/162 E X |
| 3,632,112 | 1/1972 | Jacobs | 273/162 E |
| 3,944,231 | 3/1976 | Johnson | 273/162 E |

FOREIGN PATENT DOCUMENTS

| | | | |
|---|---|---|---|
| 912515 | 12/1962 | United Kingdom | 273/162 D |

*Primary Examiner*—George J. Marlo

*Attorney, Agent, or Firm*—Malin & Haley

[57] ABSTRACT

A golf putter including a club body and a shaft connected to the club body. The club body includes a shaft connecting means on the top of the club body, a lower surface with convex side edge portions, a planar putting front surface with its center positioned half way between the side edge portions, a rear golf ball retrieval-retainer structure, and a ball marker depositing and retrieving member. The shaft includes an upper handle and a lower portion that is connected to the shaft connecting joint. The handle is on the upper end of the main portion of the shaft. The golf ball retrieval-retainer structure includes at least one hook-shaped arm extending from a lower rear side of the club body. The hook-shaped arm lies in the phantom extension of the lower surface plane passing through the lower surface of the club body. The ball marker depositing and retrieving member includes a depression in the club body for depositing the marker and a magnet on the bottom surface of the main arm for retrieving the marker.

4 Claims, 9 Drawing Figures

GOLF PUTTER

BACKGROUND OF THE INVENTION

This invention relates to a new and improved golf putter including a golf ball retrieval-retainer structure of a generally C-shaped configuration in a plan view, and a ball marker depositing-retrieving member.

In the past, many various types of golf ball retrieving clubs have been designed, such as the Charles Jacobs U.S. Pat. No. 3,632,112. The Jacobs patent discloses a device that actually is sized to grip a golf ball in order to retrieve the ball from a particular location. Also, the Harold T. Johnson U.S. Pat. No. 3,944,231 includes a rear scoop-shaped cavity for removing balls from a golf ball cup. Additional devices are disclosed in the patent to J. C. Haverbach, U.S. Pat. No. 2,213,190 and the patent to James T. Hunter U.S. Pat. No. 3,779,398.

BRIEF DESCRIPTION OF THE INVENTION

The present invention provides a tournament type golf putter that also includes the convenience of having a ball marker depositing-retrieving member as well as a ball retrieval-retainer structure for removing balls from a golf cup or the ground or the water without requiring a player to bend over in order to pick up the golf ball by hand or to deposit or remove the ball marker by hand. This new and improved tournament type golf putter includes a body having a forward planar putting surface with its center striking zone or area positioned halfway between the side edges or walls, a golf club handle connection joint on the top of the body, a lower surface with generally convexed side edge areas, a rear golf ball retrieval-retainer structure, and a ball marker depositing-retrieving member. The means for retrieving, retaining and picking up is also referred to as the retrieval retainer structure and may also be referred to as the retrieval-retainer means. The retrieval retainer structure includes arms projecting outward with a means for depositing and retrieving a ball marker, also referred to as a ball marker depositing-retrieving member or as a ball marker depositing-retrieving means. The means for depositing and retaining a ball marker is located on at least one arm of the outward projecting arm.

The rear golf ball retrieval-retainer means has a generally C-shaped outline when viewed in a plan view. The body is generally of the normal height of golf putters. The retrieval-retainer means preferably includes two generally symmetrical hook-shaped members each with a main arm, curved arm portion, and a distal end. The main arms extend rearward from the rear of the main body adjacent the side walls or edges of the body. The curved arms are connected to the end of the main arms and are positioned facing one another. The arms are positioned as mirror images to one another. The main arms are thick near the main body and slope downward to a thin curved arm portions and distal ends. The beginning height or thickness of the arms is nearly equal to the body of the putter. The curved arm portion of each hook-shaped portion curves inwardly toward each other to a provide a golf ball holding cradle. The two inwardly projecting distal ends of the arms are preferably spaced apart a distance less than the diameter of a golf ball but greater than the radius of a golf ball, allowing the structure to be moved around the golf ball without first moving the golf ball and without contacting or moving the ball marker. This allows a golf ball to be held by the distal ends of the hook shaped portion with a third supporting point on the rear face of the main body. The third supporting point is on the rear face that lies opposite the central striking zone portion.

The golf ball marker depositor-retrieving means is a depression in one of the curved arm portions that is sized to support most of the base of the marker. The marker may be placed in the depression with a portion of it extending out beyond the edge of the curved arm portions. A golfer may then move the golf club head close to the ball and then by turning the shaft slightly to turn the golf club body and the hook-shaped member to place one edge of the marker, that is the unsupported marker portion, at the correct position on the ground behind the ball. Then by moving the club body away from the marker, the golf club is moved out from under the marker to leave the member to tally supported on the ground surface. After use, the new and improved golf club includes a magnet on the bottom surface of the main arm or the hook-shaped member that allows one to easily retrieve the marker from the ground marking position.

Also, in use, the golf club and its new and improved shape for the golf ball retrieval-retainer means allows the golf ball to be picked up from a flat or rough ground surface above or below water. Further, the golf head may be moved into a cup to retrieve the ball from the cup. All this is accomplished without requiring the player to bend over and allowing the player to stand up straight.

It is an object of this invention to provide a tournament-type putter that is symmetrically weighted and provides improved golf ball retrieval-retainer means for aiding a golfer picking up a ball with the golf club.

Another object of this invention is to provide a hook-shaped retrieval-retainer for golf ball retrieval.

In accordance with these and other objects which will be apparent hereinafter, the instant invention will now be described with particular reference to the accompanying drawings.

DESCRIPTION OF THE PREFERRED EMBODIMENTS

Figure 1:
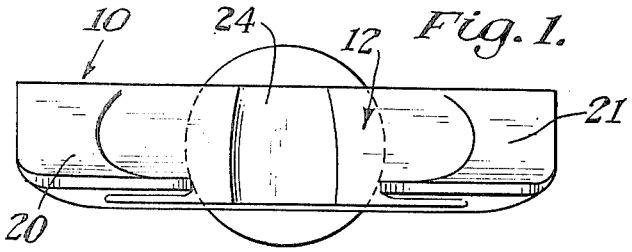
FIG. 1 is a rear view of the golf club body.
Figure 2:
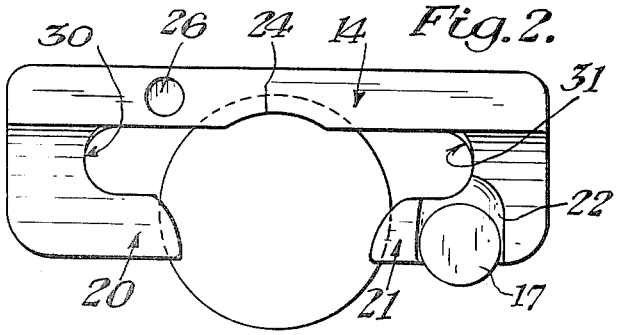
FIG. 2 is a top view of the golf club body shown in FIG. 1 with a marker in place.
Figure 6:
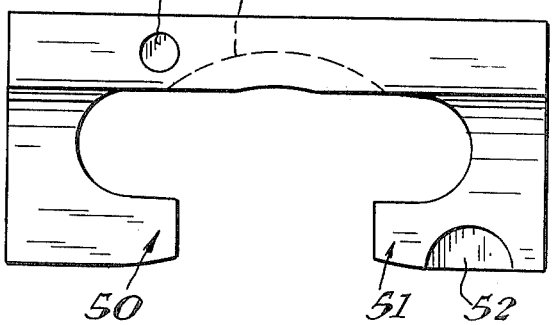
FIG. 6 is a top view of yet another club body with a third shaped retrieval-retainer means.

Referring now to FIGS. 9, 1, 2, 3, and 4, the present invention provides a tournament type golf putter 11 which includes a shaft 13, handle 15, and club body 10. The lower end of shaft 13 is bent and connected to the body 10 at 26. The center line A of the shaft 13 and the center line B of the club body 10 cross at the center of the putting face of the body. The club body 10 is shown in FIGS. 1, 2, 3, and 4 includes a ball marker depositing-retrieving means 22 including deposit impression and magnet 28 as well as a ball retrieval-retainer means 20 and 21 for removing balls from the golf cup or other locations without requiring the player to bend over in order to pick up the ball by hand or to deposit or remove the ball marker by hand. This new and improved golf putter 11 includes a body 10 having a forward planar putting surface 18 shown in FIGS. 2 and 4 with its center striking area positioned halfway between the side walls. The body also includes a handle connection means 26 shown as a hole that may be tapped. The lower surface 16 of the body 10 has convexed side edges shown in FIGS. 1 and 4. The rear golf ball body includes a retrieval-retainer structure 20 and 21 and a ball marker depositor-retriever member shown at 22 and 28. Marker 17 is shown in FIG. 2 as a metal marker.

The rear golf ball retrieval-retainer means has a generally C-shaped outline when viewed in a plan view shown in FIGS. 2, 3, 5, 6, 7, and 8. The body is generally of the normal height of a golf putter. The retrieval-retainer means shown in FIGS. 2, 5, 6, 7, and 8 includes two generally symmetrical arms 20-21, 40-41, 50-51, 60-61, and 70-71 respectively. The main arms adjacent numerals 20 and 21 extend in a rearward direction from the rear surface 12 of the body adjacent numerals 30 and 31 in FIG. 2. Each side of the body is a mirror image of the other in the preferred embodiment, although one retrieval-retainer means may be used from above to lift a golf ball out of a golf cup. The main arms 20 and 21 slope outwardly and rearwardly with a height or thickness that is near the height of the body of the putter. The main arms slope downwardly to a rather thin surface that also curve inwardly with a main curved member or portion (hook-like) toward the center of the body along line B in FIG. 9. The two inwardly projecting distal ends of the arms are preferably spaced apart a distance less than the diameter of a golf ball. This allows a golf ball to be held in the distal ends with a third supporting point on the rear face of the golf ball body.

The ball may also be held by one hook with the body tilted toward one side.

It should be noted that the arc-shaped surface 24, 44, 54, 64, and 74 is used to reduce the weight of the golf ball body.

Figure 3:
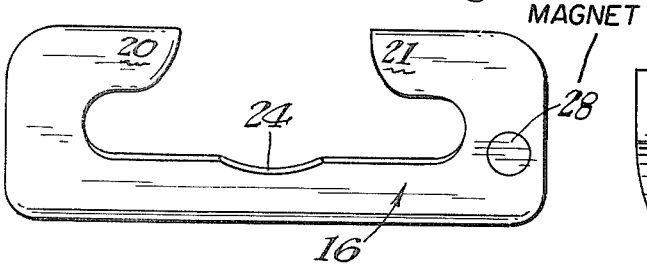
FIG. 3 is a bottom view of the golf club body shown in FIG. 1.
Figure 7:
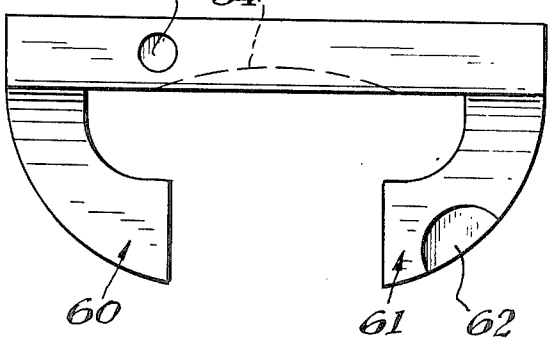
FIG. 7 is a top view of a further club body with a fourth shaped retrieval-retainer means.
Figure 4:
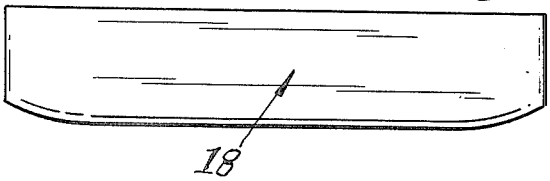
FIG. 4 is a front view of the golf club body shown in FIG. 1.
Figure 5:
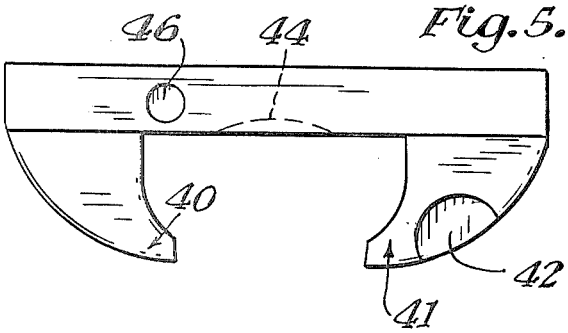
FIG. 5 is a top view of another club body with a second shaped retrieval-retainer means.
Figure 8:
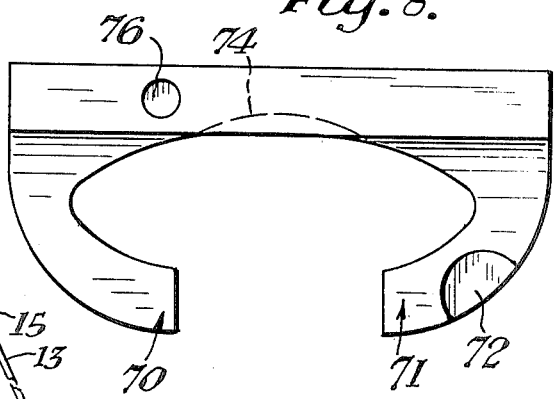
FIG. 8 is a top view of an additional club body with a fifth shaped retrieval-retainer means.
Figure 9:
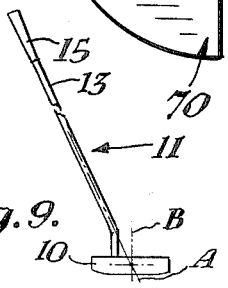
FIG. 9 is a side view of the golf club with its handle and the golf club head body.

The golf ball marker depositor-retrieving means is shown as a depression 22, 42, 52, 62, or 72, shown in FIGS. 2, 5, 6, 7, and 8. The depositor-retrieving means is in one of the arms that is sized to hold a marker such as 17 shown in FIG. 2. The marker may be placed in the depression with a portion of it extending out beyond the arm surface. Thereafter, a golfer may move the head close to the ball and then by turning the golf club slightly, he may then place one edge of the marker at the correct position behind the ball on the ground and then slip the golf club curved portion of the arm out from under the marker that has an edge supported by the ground surface. After use, the new and improved golf club includes a magnet 28, as shown in FIG. 3, on the bottom surface of the club head that allows one to easily retrieve the marker from the ground position.

In use, the golf club and its new and improved shape allows the retrieval-retainer means to be used to pick up a golf ball from a flat surface or allows the golf head to be moved into a cup to retrieve the ball from the cup as well as from other positions. The club also allows a marker to be placed and removed easily.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A golf putter, comprising:

a club body having a front surface, a top surface, side walls, and a rear surface including;

a generally planar putting surface on said front surface of said body, said planar putting surface having a central striking zone portion generally located halfway between the side walls, said club body including a golf club shaft connecting area, a means for retrieving, retaining and picking up a golf ball from a surface and out of a cup, said means for retrieving, retaining and picking up connected to said body, said means for retrieving, retaining and picking up including two hook structures, each said hook structure having one end connected to said rear surface of said club body and a distal end, said distal ends projecting inwardly toward each other, said hook structures in spaced apart relation a distance less than the diameter of a golf ball, but greater than the radius of a golf ball, substantially perpendicular to said generally planar putting surface of said club head, and of appropriate thickness whereby the golf ball may be picked up by contact with the lower half of the golf ball without first moving the golf ball.

2. A golf putter as set forth in claim 1, further comprising: a ball marker depositing-retriever means for allowing placement and retrieval of a ball marker by a golfer in a substantially upright position, said ball marker depositing-retriever means connected to said club body.

3. A golf putter as set forth in claim 2, wherein: said ball marker depositing-retriever means includes a depression in said club head for placing said ball marker and a magnet for retrieving said ball marker.

4. A golf putter as set forth in claim 1 or claim 2, further including:

a golf club shaft connected to said golf club shaft connecting area.

* * * * *